US006669542B1

(12) United States Patent
Walz et al.

(10) Patent No.: US 6,669,542 B1
(45) Date of Patent: Dec. 30, 2003

(54) ANGLE GRINDER

(75) Inventors: Roland Walz, Stuttgart (DE); Peter Stierle, Waldenbuch (DE); Ralph Dammerz, Stuttgart (DE); Maria-Margaretta Sulea, Leinfelden-Echterdingen (DE); Stefan Heess, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 09/914,369

(22) PCT Filed: Nov. 25, 2000

(86) PCT No.: PCT/DE00/04209

§ 371 (c)(1),
(2), (4) Date: Aug. 27, 2001

(87) PCT Pub. No.: WO01/51250

PCT Pub. Date: Jul. 19, 2001

(30) Foreign Application Priority Data

Jan. 10, 2000 (DE) ..... 100 00 702

(51) Int. Cl.[7] ..... B24B 23/00

(52) U.S. Cl. ..... 451/352; 451/344; 451/358; 451/359

(58) Field of Search ..... 451/352, 344, 451/359, 358

(56) References Cited

U.S. PATENT DOCUMENTS

| | | | | | |
|---|---|---|---|---|---|
| 4,895,212 | A | * | 1/1990 | Wache | 173/48 |
| 5,349,785 | A | | 9/1994 | Nickels | |
| 5,718,621 | A | * | 2/1998 | Turley | 451/342 |
| 5,794,300 | A | * | 8/1998 | McCracken et al. | 15/97.1 |
| 6,168,507 | B1 | * | 1/2001 | McCracken | 451/357 |
| 6,290,587 | B1 | * | 9/2001 | McCracken et al. | 451/357 |
| 6,293,859 | B1 | * | 9/2001 | Fink et al. | 451/344 |
| 6,454,640 | B1 | * | 9/2002 | Siedler et al. | 451/357 |

* cited by examiner

*Primary Examiner*—George Nguyen
*Assistant Examiner*—Alvin J. Grant
(74) *Attorney, Agent, or Firm*—Michael J. Striker

(57) ABSTRACT

An angle grinder with a housing 2 can be produced more economically by providing that it has a mounting shell 3, a cap shell 4, and an insert part 1 between these two shells. The insert part 1 is equipped with a first fixation device 10 and a second fixation device 11 for fixation between the mounting shell 3 and the cap shell 4, and it has a spindle locking receptacle 12 and spindle bearing receptacle 13. The mounting shell 3 has a first fixation means 30, which is engaged by the first fixation device 10 of the insert part 1. The cap shell 4 has a second fixation means 40, which engages the fixation device 10 of the insert part 1. The insert part 1 also has a second fixation device 11, which can be brought into engagement with suitable means on the mounting shell 3 and the cap shell 4.

9 Claims, 4 Drawing Sheets

ANGLE GRINDER

PRIOR ART

Figure 3:
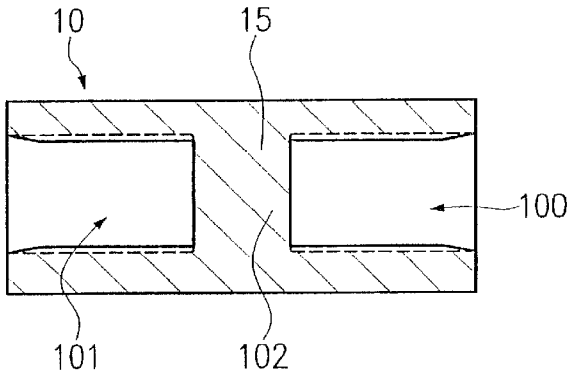

The invention is based on an angle grinder as generically defined by the preamble to claim 1.

An angle grinder with such a housing is known from German Patent Disclosure DE 43 44 128. The housing in this case is in one piece and is screwed onto a cup-shaped motor housing. A spindle bearing receptacle in which the bearing for a work spindle is received is embodied integrally with the housing. For changing a tool that is mounted on the work spindle, the work spindle has to be fixed. This is done by providing that a spindle lock, by means of a hand lever and counter to the force of a restoring spring, presses a detent cam into an indentation that is embodied on a clamping flange, which in turn is connected to the work spindle in such a way that it rotates with it. In the operation of the work spindle and when the tool secured to it is changed, major forces, or clamping forces, occur. It is therefore necessary that both the spindle bearing receptacle and the locking device comprise a high-quality, wear-resistant material. Since the spindle bearing receptacle is embodied integrally with the housing, the entire housing must be made from such a high-quality, expensive material.

ADVANTAGES OF THE INVENTION

The angle grinder of the invention as defined by the characteristics of claim 1 has the advantage over the prior art that the entire housing can be made by shell construction and can be fabricated from an economical material; only the insert part to be inserted separately into the housing has to comprise especially high-quality material. The possibility is thus afforded of producing a less expensive product than was previously possible. This is made possible by the fact that the entire housing is made of shell construction, that is, with a mounting shell and a cap shell, between which the insert part is inserted. Because the insert part is fixed with its first and second fixation device between the mounting shell and the cap shell, the spindle bearing receptacle and the spindle locking receptacle, also disposed in the insert part, always remain stationary in their position relative to the housing.

It is advantageous if the spindle bearing receptacle and the spindle locking receptacle are disposed parallel to one another in a base body of the insert part, and if this base body has an aperture oriented perpendicular to the spindle locking receptacle, which is embodied as a through hole. As a result, it is possible for the insert part to be well fixed in its position between the mounting shell and the cap shell, each of which have a screw dome that is disposed in a line with the through hole.

It is also advantageous if the insert part has an outrigger, on which a first fixation device is disposed, the cross section of the outrigger being in the form of a double T. The first fixation means of the mounting shell and second fixation means of the cap shell can easily engage the resultant indentations on both sides of the outrigger, thus assuring good fixation of the angular position of the insert part in the housing between the two shells.

It is also advantageous if the insert part comprises a high-quality, wear-resistant material, while conversely the mounting shell and the cap shell are of an inexpensive material. This is made possible because only the spindle bearing receptacle and the spindle locking bolt experience heavy loads, while the remaining points of the housing experience hardly any load. As material for the insert part, Grivory or a similar material is used. This is a glass-fiber-reinforced, heavy-duty polyamide plastic, such as PA 6-66 GF.

An advantageous fixation of the insert part in the housing is achieved by the provision that the outrigger of the insert part rests over a large surface area on first and second bearing faces of the mounting shell and cap shell, respectively.

Advantageously, in the region of its through hole, the insert part has first and second centering devices, oriented toward each of the screw domes, that can be brought into engagement with first and second centering means of the screw domes. As a result, centering and thus correct insertion of the insert part between the mounting shell and the cap shell are assured.

Further advantageous features of the invention will become apparent from the other dependent claims.

DRAWINGS

Figure 1:
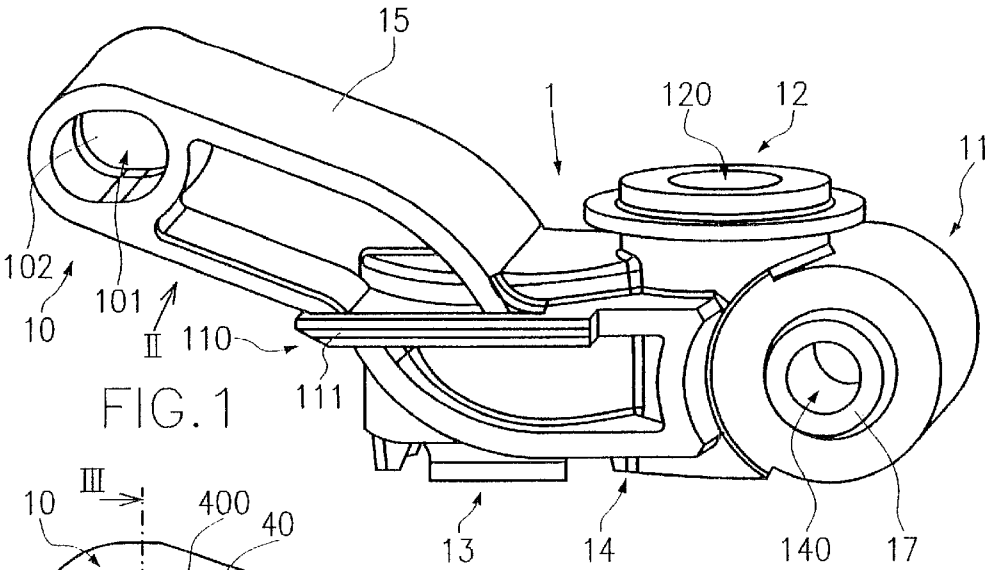
Figure 2:
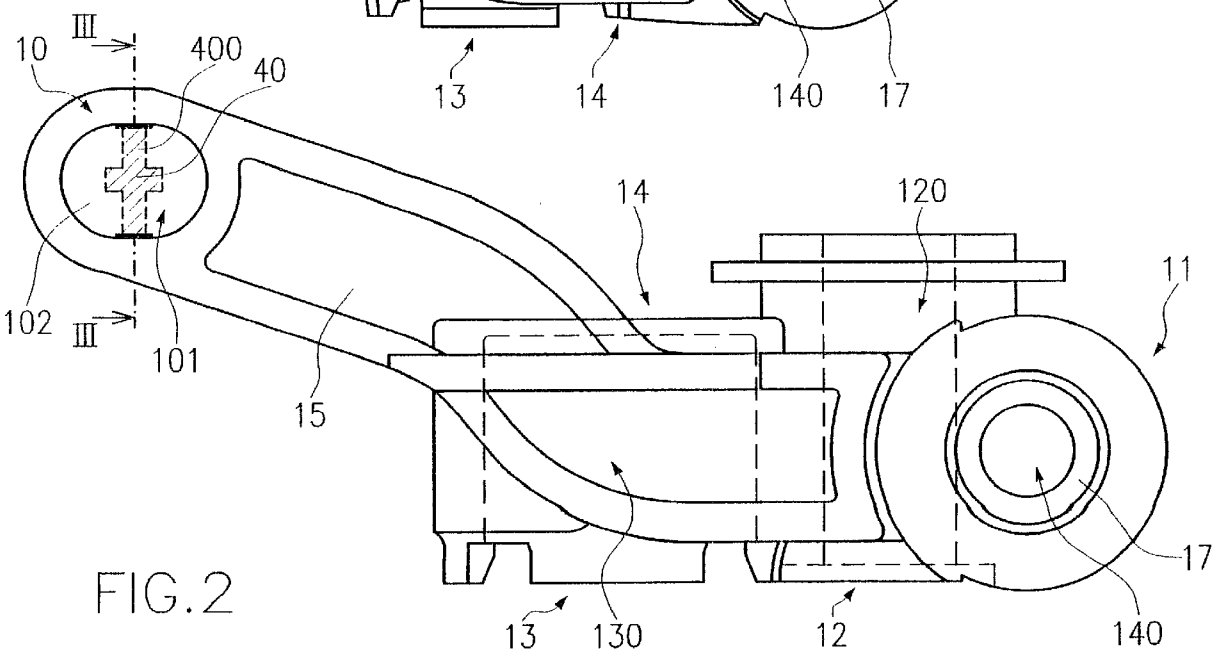
Figure 4:
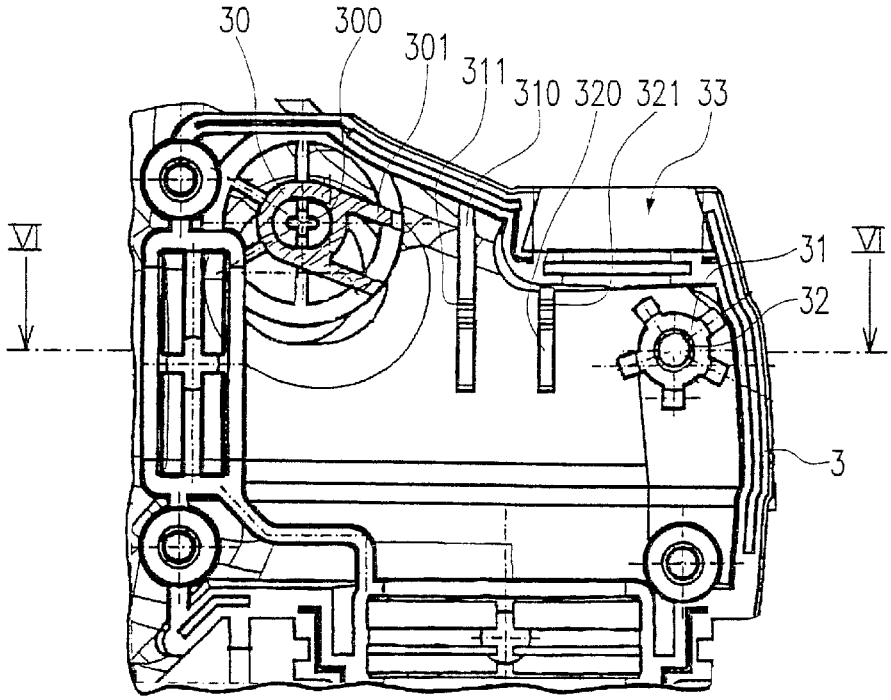
Figure 5:
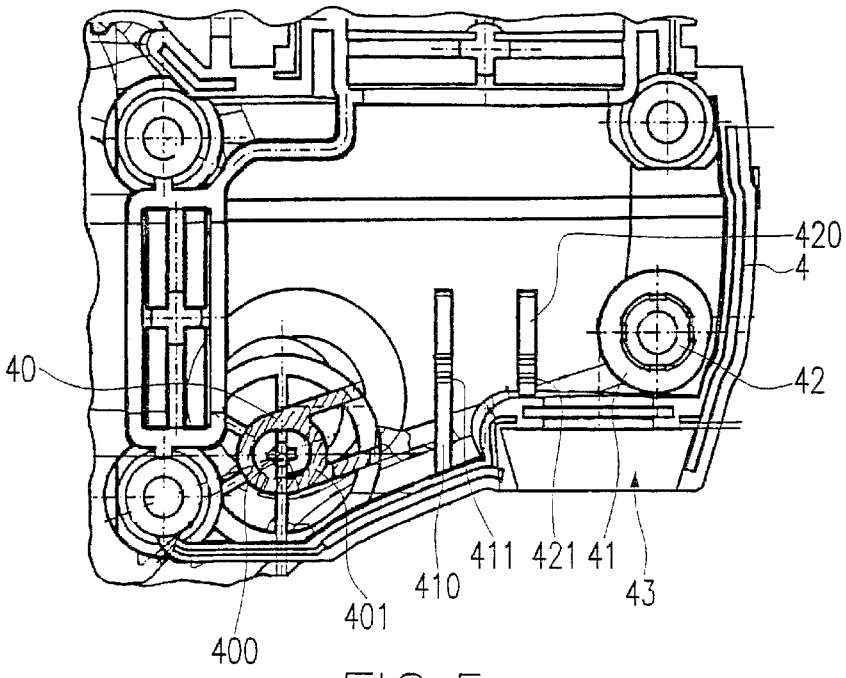
Figure 6:
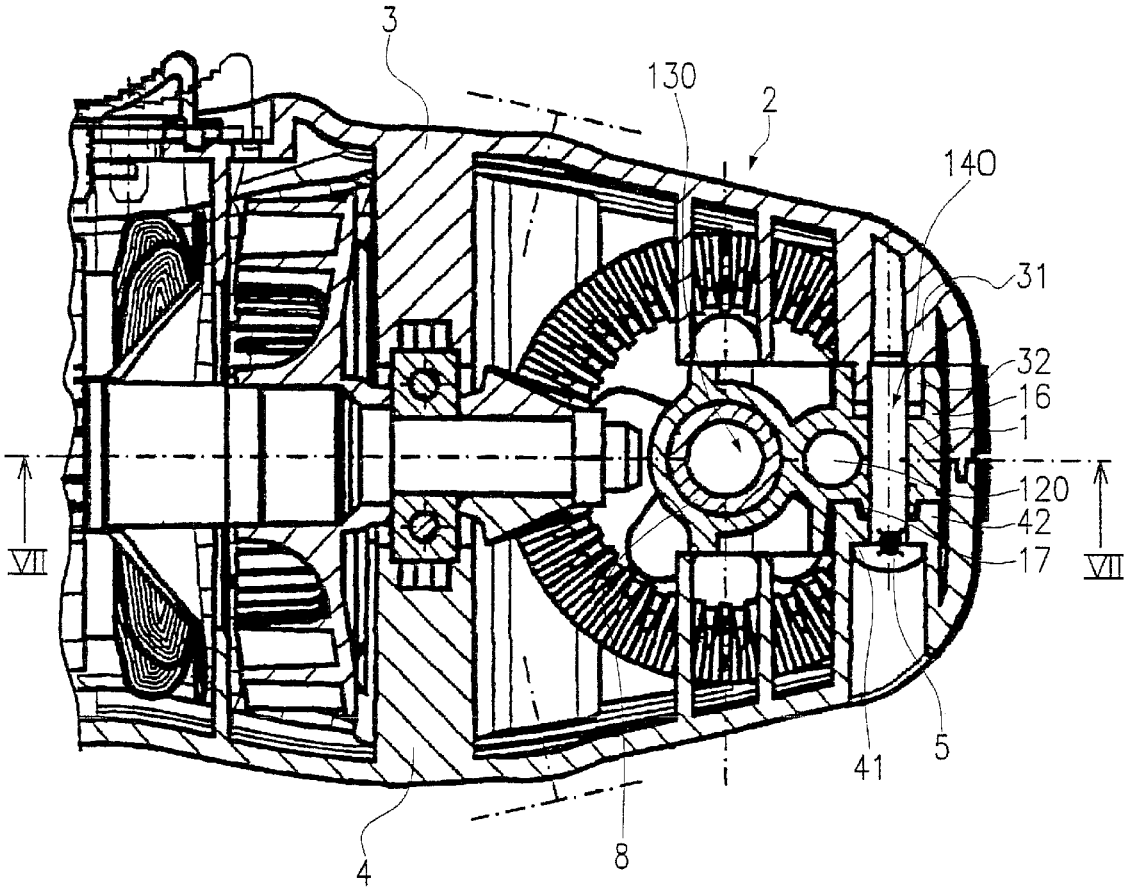
Figure 7:
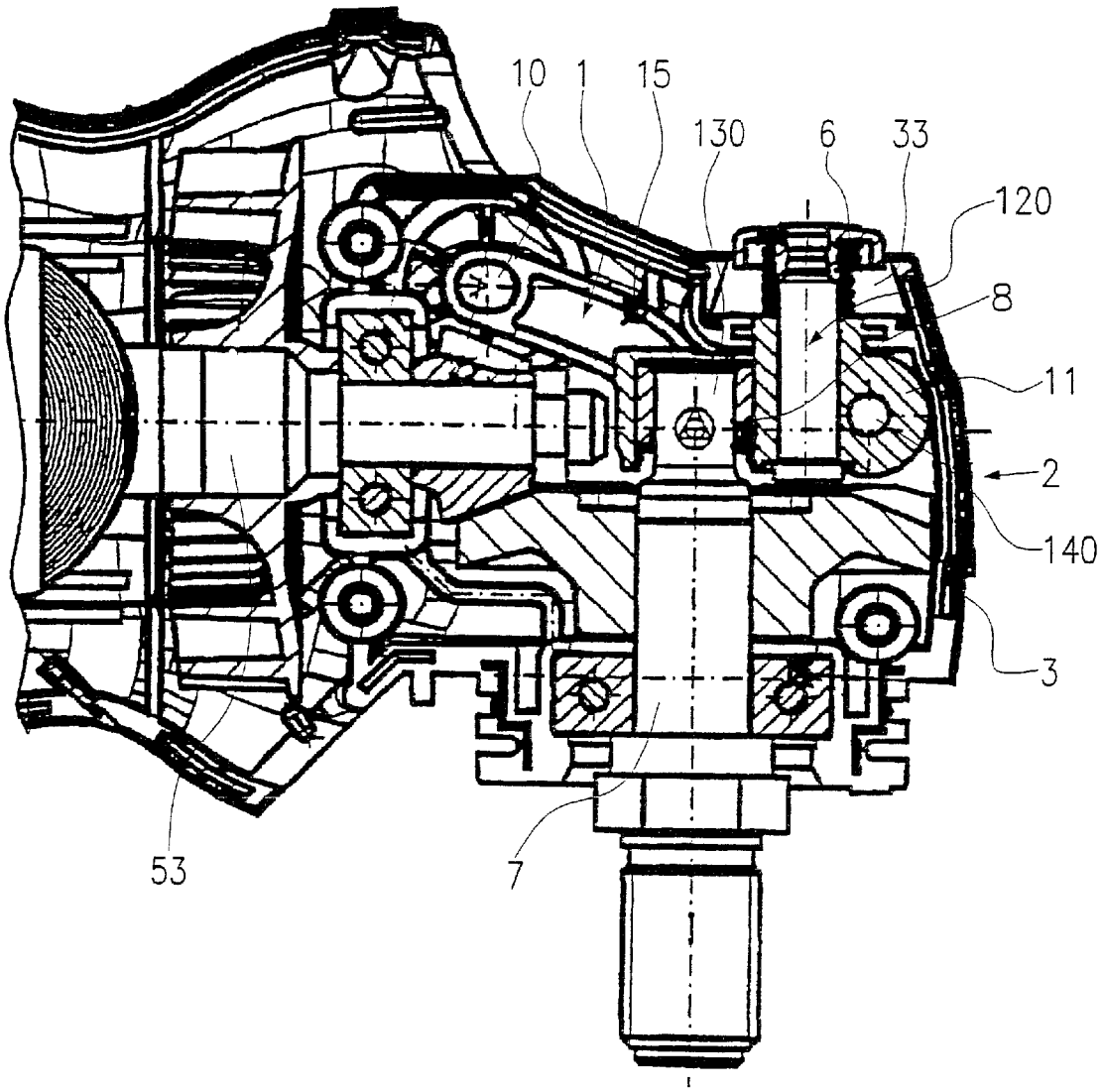

The invention is explained in further detail in the ensuing description of an exemplary embodiment shown in the drawings. Shown are:

FIG. 1, a perspective view of an insert part;

FIG. 2, the plan view on the insert part of FIG. 1 in the direction II;

FIG. 3, a cross section through the insert part taken along the plane III—III of FIG. 2;

FIG. 4, a plan view on the inside face of a mounting shell;

FIG. 5, a plan view on the inside of a cap shell;

FIG. 6, a section through a fully assembled housing taken along the plane VI—VI of FIG. 4; and FIG. 7, a section through a fully assembled housing taken along the plane VII—VII of FIG. 6.

DESCRIPTION OF THE EXEMPLARY EMBODIMENTS

FIGS. 1 and 2 show views of an insert part 1. Identical parts are identified by the same reference numerals. The insert part 1 has a base body 14 and an outrigger 15. A spindle bearing receptacle 13, spindle locking receptacle 12, and second fixation device 11 are embodied on the base body 14. The spindle bearing receptacle 13 is embodied as a blind bore 130 (shown in dashed lines in FIG. 2). The spindle locking receptacle 12 is designed as a through hole 120 (shown in dashed lines in FIG. 2). The longitudinal center axes of the through hole 120 and the blind bore 130 are oriented parallel. The second fixation device 11 has an aperture 140, which is oriented perpendicular to the plane defined by the two longitudinal center axes of the through hole 120 and the blind bore 130. A first centering device 16 (see FIG. 6) and a second centering device 17 are embodied in the region around each of the two openings of the through hole 120.

Fins 110, 111 are provided laterally on the base body 14. The fin 111 is embodied as a rib protruding from the base body 14. The fin 110 is located symmetrically on the opposite side of the base body 14. These fins 110, 111 are provided in order to fix the insert part in the installed state and in particular to prevent torsion about the axis of the motor.

The outrigger 15 of the insert part 1 is embodied integrally with the base body 14 and extends outward from the spindle bearing receptacle 13. A first fixation device 10 is embodied on the end of the outrigger 15 remote from the base body 14.

The entire outrigger 15 is embodied in the shape of a double T. The shape of the outrigger 15 is illustrated by the first fixation device 10, in the cross section shown in FIG. 3. Because of the double T shape, there are two indentations 100, 101, separated from one another by a wall 102. The wall 102 extends in the plane defined by the center longitudinal axes of the blind bore 130 and the through hole 120. The first indentation 100 and the second indentation 101 are U-shaped in cross section. In the plan view of FIG. 2, they have an oval shape. It is shown in suggested fashion in FIG. 2 how a second fixation means 40, in the form of a second rib 400 which is embodied on a cap shell 4 (see FIG. 5), engages the second indentation 101.

FIG. 4 shows the inside of a mounting shell 3 of a housing 2 (see FIGS. 6 and 7). Below, only those parts of the mounting shell 3 essential to the invention will be described. The mounting shell 3 has a first rib 300, which in the installed state of the housing 2 engages the first indentation 100 of the outrigger 15 (see FIG. 3) in such a way that the insert part 1 (see FIGS. 1–3) is fixed with its first fixation device 10 in its angular position relative to the mounting shell 3. In this position the outrigger 15 (see FIGS. 1–3) rests with a large surface area on the first bearing face 301. The mounting shell 3 also has a first screw dome 31. A first centering means 32, which is in engagement with the first centering device 16 (see FIG. 6) in the installed state of the housing 2, is embodied on the first screw dome 31, around an opening that serves to receive a screw. The mounting shell 3 also has a first receiving opening 33, through which a spindle locking bolt 6 (see FIG. 7) can be introduced through the through hole 120 (see FIGS. 1, 2, 6 and 7) into the spindle locking receptacle 12 of the base body 14 of the insert part 1. The mounting shell 3 furthermore has a first rib 310 and a second rib 320 with recesses 311 and 321, respectively, for receiving the fin 110. Further details of the relative position between the mounting shell 3 and the insert part 1 will be described in conjunction with FIGS. 6 and 7.

FIG. 5 shows the inside of the cap shell 4, which in the state in which it is assembled with the mounting shell 3 is attained by folding it upward about the center axis between FIGS. 4 and 5. Once again, only those parts essential to the invention will be described below. A second bearing face 401 assures that the insert part 1 with its outrigger 15, in the installed state of the housing 2, will also rest over a large surface area on the cap shell 4, in addition to the above-described large-area contact with the mounting shell 3. On the inside of the cap shell 4 as well, a second rib 400 also engages the second indentation 101 of the first fixation device 10 of the insert part 1 (see FIG. 2). The cap shell 4 also has a second screw dome 41, which in the installed state is aligned with the first screw dome 31 of the mounting shell 3. The second screw dome, around its opening, has a second centering means 42, which in the installed state of the housing 2 is in engagement with the second centering device 17 of the second fixation device 11 of the insert part 1 (see FIGS. 1 and 2). In addition, the cap shell 4 has a second receiving opening 43, which in the installed state of the housing 2 has a receiving opening, cohesive with the first receiving opening 33 of the mounting shell 3, into which the spindle locking bolt 6 (see FIG. 7) can be introduced. A first rib 410 and a second rib 420 with respective recesses 411 and 421 are also provided for receiving the fin 111.

FIG. 6 shows the front region of the housing 2 in its fully assembled state, once the insert part 1 has been placed between the mounting shell 3 and the cap shell 4. The blind bore 130, in which a spindle bearing 8 for receiving the work spindle 7 (not shown) is disposed, can be seen on the insert part 1. The through hole 120 embodied parallel to the blind bore 130 can also be clearly seen. The aperture 140 oriented perpendicular to the plane that is defined by the longitudinal center axes of the through hole 120 and the blind bore 130 is disposed in alignment with the first screw dome 31 of the mounting shell 3 and the second screw dome 41 of the cap shell 4. For the sake of simple centering of the insert part 1 between the mounting shell 3 and the cap shell 4, a first centering means 32 on the first screw dome 31 engages a first centering device 16 on the insert part 1. In addition, a second centering device 17 on the insert part 1 also engages a second centering means 42 on the second screw dome 41 of the cap shell 4. For secure positional fixation of the individual parts of the housing 2 relative to one another, a screw 5 is passed through the second screw dome 41, the aperture 140, and this screw engages the first screw dome 31 and thus brings about secure fixation.

FIG. 7 shows the three-dimensional disposition of the insert part 1 in the mounting shell 3. The outrigger 15 with its first fixation device 10 rests over a large surface on the first bearing face 301 (see FIG. 4) of the mounting shell 3. The first rib 300 of the first fixation means 30 on the mounting shell 3 engages the first indentation 100 of the first fixation device 10, as described in conjunction with FIG. 4. As a result, a fixation of the angular position of the insert part 1 relative to the mounting shell 3 is achieved. To prevent torsion of the insert part 1 in the mounting shell 3 and thus in the housing 2, there is not only the fixation just described by means of the first fixation device 10 but also the second fixation device 11 as described in conjunction with FIG. 4. In the blind bore 130, the work spindle 7 is supported in the spindle bearing 8 rotatably relative to the insert part 1. To fix the work spindle 7 so a tool can be changed, a spindle locking bolt 6 is introduced through the first receiving opening 33 in the through hole 120.

The mounting of the housing 2 is effected as follows:

The insert part 1 is placed in the mounting shell 3 in such a way that the position described in conjunction with FIGS. 1–7 is reached. This essentially means that the first fixation device 10 is made to engage the first fixation means 30, and the second fixation device 11 is centered relative to the first screw dome 31 such that the aperture 140 is oriented in alignment with the first screw dome 31. The fin 110 of the insert part 1 comes to rest in the recess 311 of the first rib 310 and in the recess 321 of the second rib 320. The cap shell 4 is thereupon placed on the mounting shell 3 in such a way the second fixation means 40 engages the first fixation device 10, and the second screw dome 41 is oriented in alignment with the aperture 140 and the first screw dome 31. This also causes the fin 111 to engage the recess 411 of the first rib 410 and the recess 421 of the second rib 420. This assures an additional security against torsion of the insert part 1, in particular longitudinally to the motor axis. After that, the cap shell 4 is screwed to the mounting shell 3 by means of the screw 5, as described above.

What is claimed is:

1. An angle grinder, having a housing (2) comprising two half-shells (3, 4), for receiving both a motor (50) and a gear (55) with a drive spindle (53), characterized in that an insert part (1) for reinforcing the housing is disposed between the half-shells (3, 4) in the region of the gear (53), wherein the insert part (1) has a first fixation device (10) and a second fixaton device (11) for fixing the insert part (1) between a mounting shell (3) and cap shell (4) of the housing (2) and a spindle locking receptacle (12) with a spindle bearing receptacle.

2. The angle grinder of claim 1, characterized in that the spindle bearing receptacle (13) is a blind bore (130), and/or the spindle locking receptacle (12) is a through hole (120).

3. The angle grinder of claim 2, characterized in that the base body (14) has an aperture (140), which is oriented perpendicular to the through hole (120).

4. The angle grinder of claim 1, characterized in that it has a base body (14), in which the spindle bearing receptacle (13) and the spindle locking receptacle (12) are disposed parallel to one another.

5. A method for assembling an angle grinder, wherein said angle grinder has a housing (2) comprising two half-shells (3, 4), for receiving both a motor (50) and a gear (55) with a drive spindle (53), wherein an insert part (1) for reinforcing the housing is disposed between the half-shells (3, 4) in the region of the gear (53), said method having the following steps:

inserting the insert part (1) into a mounting shell (3), so that the first fixation device (10) of the insert part (10) is in engagement with first fixation means (30) of the mounting shell (3), and a second fixation device (11) of the insert part (1) is in engagement with a first screw dome (31) of the mounting shell (3), and in particular a first centering device (16) is in engagement with a first centering means (32);

placing a cap shell (4) on the preassembled component, so that the first fixation device (10) of the insert part (1) is in engagement with second fixation means (40) of the cap shell (4), and the second fixation device (11) of the insert part (1) is in engagement with a second screw dome of the cap shell (4), and in particular a second centering device (17) is in engagement with a second centering means (42);

positionally fixing the cap shell (4) relative to the mounting shell (3), in particular by screwing a screw (5) into the two screw domes (31, 41) and through the insert part (1).

6. An angle grinder, having a housing (2) comprising two half-shells (3, 4), for receiving both a motor (50) and a gear (55) with a drive spindle (53), characterized in that an insert part (1) for reinforcing the housing is disposed between the half-shells (3, 4) in the region of the gear (53), and further comprising an outrigger (15), on which a first fixation device (10) is disposed, wherein a cross section of the outrigger is preferably in the shape of a double T, so that the first fixation means (30) of a mounting shell (3) and a second fixation means (40) of a cap shell (4) can engage two indentations (100, 101) of the first fixaton device (10).

7. A housing (2) having an insert part (1) for reinforcing the housing, said housing (2) having a mounting shell (3), whose first fixation means (30) engages the first fixation device (10) of the insert part (1), and having a first screw dome (31), which is disposed in a line with the through hole (120) of the insert part (1), and having a cap shell (4), whose second fixation means (40) engages the first fixation device (10) of the insert part (1), and having a second screw dome (41), which is disposed in a line with the through hole (120) of the insert part (1), so that a screw (5) can be passed through the two screw domes (31, 41) and the through hole (120) of the insert part (1).

8. The housing (2) of claim 7, characterized in that the outrigger (15) of the insert part (1) rests over a large surface area on both the mounting shell (3) and the cap shell (4).

9. The housing (2) of claim 7, characterized in that the insert part (1), in the region of its through hole (120), has first and second centering devices (16, 17), oriented toward each of the screw domes (31, 41), which devices are in engagement with first and second centering means (32, 42) of the screw domes (31, 41).

* * * * *